United States Patent [19]

Upchurch et al.

[11] Patent Number: 4,490,070

[45] Date of Patent: Dec. 25, 1984

[54] HEAVY-DUTY TRENCH COMPACTOR

[75] Inventors: Otha D. Upchurch, Millersville; Marvin F. Bosley, Laurel, both of Md.

[73] Assignee: Dumbco Inc., Beltsville, Md.

[21] Appl. No.: 73,562

[22] Filed: Sep. 7, 1979

[51] Int. Cl.[3] ..... E01C 19/26

[52] U.S. Cl. ..... 404/121; 404/128; 404/129; 37/DIG. 3

[58] Field of Search ..... 404/127, 128, 122, 121, 404/126, 125, 117; 37/117.5, DIG. 3; 214/145

[56] References Cited

U.S. PATENT DOCUMENTS

| | | | |
|---|---|---|---|
| 1,631,271 | 6/1927 | Keeler | 404/127 |
| 2,437,524 | 3/1948 | Harrison . | |
| 2,587,463 | 2/1952 | Guignard | 404/125 |
| 2,624,251 | 1/1953 | Porter | 404/122 |
| 2,678,594 | 5/1954 | Wilson | 404/126 |
| 2,891,335 | 6/1959 | Linneman | 404/127 |
| 3,183,804 | 5/1965 | Le Tourneau . | |
| 3,302,540 | 2/1967 | Fuentes | 404/127 |
| 3,437,383 | 4/1969 | Randour . | |
| 3,595,411 | 7/1971 | Ables | 214/145 |
| 3,633,471 | 1/1972 | Randour . | |
| 3,891,342 | 6/1975 | Roe | 404/128 |
| 3,897,165 | 7/1975 | Vurac | 404/117 |
| 4,066,374 | 1/1978 | King | 404/117 |
| 4,100,688 | 7/1978 | Grist | 37/117.5 |

FOREIGN PATENT DOCUMENTS

| | | | |
|---|---|---|---|
| 805293 | 11/1936 | France | 404/122 |
| 527563 | 10/1940 | United Kingdom | 404/122 |
| 571105 | 8/1945 | United Kingdom | 404/121 |

OTHER PUBLICATIONS

Brochure by Earth Pack Industries, entitled "New, In Soil Compaction".

*Primary Examiner*—James A. Leppink

*Attorney, Agent, or Firm*—Cushman, Darby & Cushman

[57] ABSTRACT

A compactor assembly and method of utilization thereof to compact soil in a trench are provided that do not require the hydraulic boom to which the compactor assembly is mounted to exert downward pressure to effect compacting. A sheep's foot roller defined by a cylindrical surface with a plurality of feet extending radially therefrom is mounted for rotation with respect to an axle having a length less than the length of the roller. The axle is completely contained within the interior volume defined by the roller's cylindrical surface. A frame operatively mounts to a crawler excavator or the like, the frame including a pair of side plates, a top plate, and back plate, and the axle is mounted to the frame side plates so that the axle remains stationary with respect to the side plates and the roller rotates about the axis defined by the axle. Each of the feet comprises a solid member tapered to a truncated apex in a circumferential direction, and having a pair of parallel flat spaced sides in an axial direction. A cleaning comb defined by a number of cleaning comb plates effects cleaning of the feet. Each cleaning comb plate has parallel faces which effect cleaning of the flat side faces of adjacent axially spaced feet, and each cleaning comb plate has an arcuate edge portion that extends the entire circumferential distance of the roller within the volume defined by the frame and side plates and top and bottom plates.

11 Claims, 6 Drawing Figures

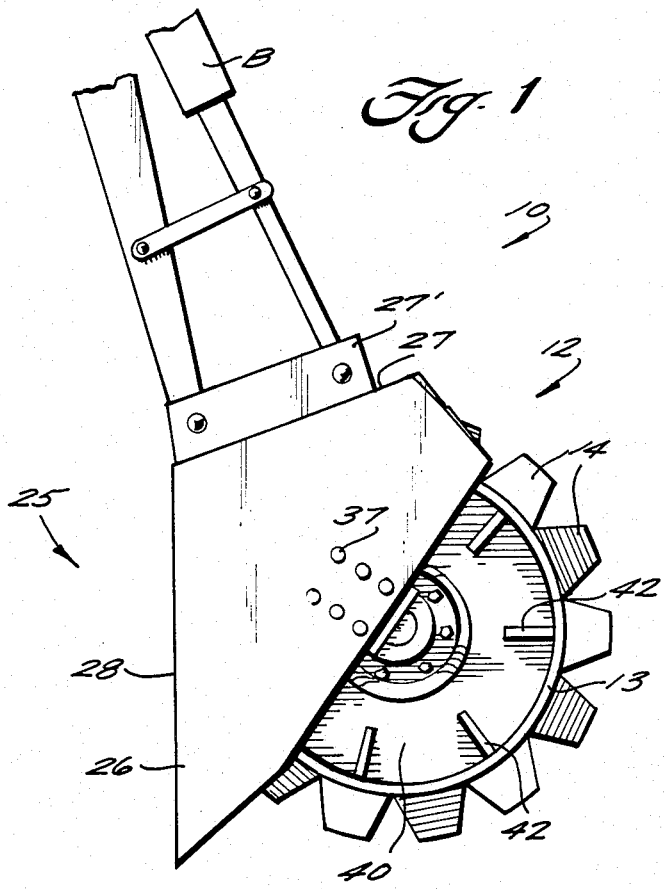
Fig. 1
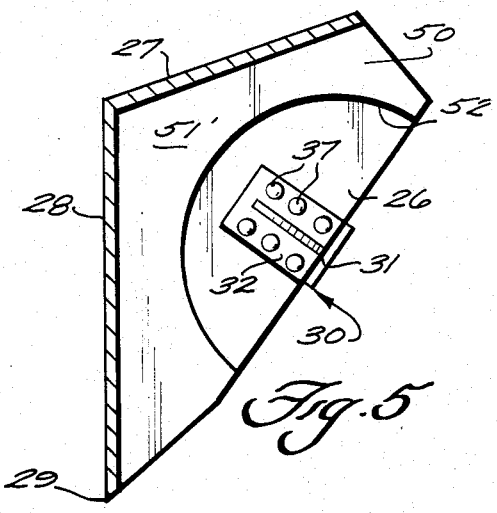
Fig. 5
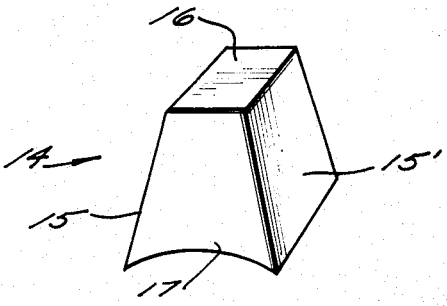
Fig. 6
Fig. 2
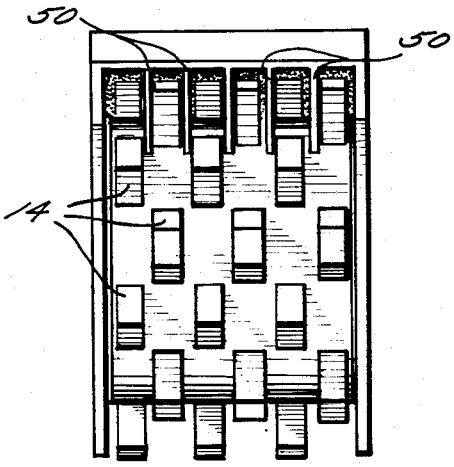
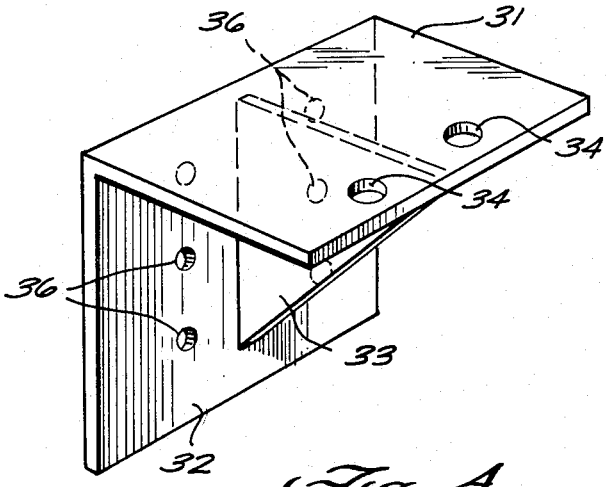
Fig. 4

HEAVY-DUTY TRENCH COMPACTOR

BACKGROUND AND SUMMARY OF THE INVENTION

In the construction in repair of a wide variety of facilities, it is necessary to dig trenches and lay sewer pipes, gas pipes, conduits, or the like in the trenches so formed, and then fill in the trenches. In order to prevent complications that may result from soil in the trenches settling, it is highly desirable to compact the soil in the trenches once they are formed, and as they are filled, and for this purpose a wide variety of compacting roller assemblies have been developed, such as shown in U.S. Pat. Nos. 3,891,342; 2,891,335; and 3,595,411.

It is highly desirable to provide compacting roller assemblies that may readily be attached to existing equipment utilized in the construction and filling of the trenches, such as conventional crawler excavators and the like. Available compacting roller assemblies have not been entirely successful in performing their designed functions in all types of trench environments, however, and especially when employed in heavy-duty applications with crawler excavators and the like. Commercially-available roller compacting assemblies experience problems of feet breakage, quick destruction of the structure (i.e., bearings and axles) for mounting the rollers, and insufficient cleaning of the roller feet and/or breakage of the cleaning combs. Additionally, it is necessary to provide a downward pressure on the roller with the hydraulic boom mounting the roller assembly in order to effect sufficient compaction, which can result in reduced life of the hydraulic boom and/or reduce life of the roller mounting components due to excessive stress applied thereto.

According to the present invention, a compactor assembly and method of utilization thereof are provided which eliminate the drawbacks associated with prior art compacting assemblies. The compactor assembly according to the present invention is especially adapted for heavy-duty use, such as mounting to a crawler excavator, and can be used in a wide variety of heavy-duty applications without destruction of the roller feet, without destruction of the roller rotatable mounting devices, and with effective cleaning of the feet during use. Additionally, the weight of the compactor assembly is significantly greater than that of commercially-available assemblies (e.g., 2300 lbs. vs. 400 lbs.), and can thus perform its compacting functions without requiring the hydraulic boom (of the crawler excavator or the like) to which it is mounted to exert any downward pressure, and without the necessity for vibrating the roller to achieve effective compaction.

The compactor assembly according to the present invention comprises a sheep's foot roller having a plurality of feet extending radially outwardly from an exterior cylindrical surface thereof, the cylindrical surface having a central axis and having an axial length L, and defining an open interior volume. An axle is provided having a length L' less than the length L, and means are provided for mounting the axle along the roller cylindrical surface central axis so that the axle is completely contained within the interior volume defined by the cylindrical surface and thus the possibilities of damage thereto are minimized. A frame operatively mounts the roller to a crawler excavator or the like, the frame comprising a pair of side plates and at least one cross-plate, and means for mounting the axle to the frame side plates are provided so that the roller rotate about the axis. The means for mounting the axle are preferably mounted so that the axle remains stationary with respect to the side plates and the roller rotates about the axle, a lifetime heavy-duty sealed bearing assembly being provided between the roller and axle.

Also, according to the present invention, the feet are disposed in a plurality of series, each series including a plurality of feet extending circumferentially around the roller and each series being axially spaced from an adjacent series. Each of the feet comprises a solid member tapered to a truncated apex in a dimension extending radially outwardly from the cylindrical surface of the roller with each truncated apex disposed in a plane parallel to a tangent to the roller. Each foot has a pair of parallel flat spaced sides, each flat side disposed in a plane perpendicular to the axis of rotation of the roller, and each flat side disposed in a common plane with the flat sides of the other feet in its respective circumferential series of feet. Such solid feet provide maximum compaction and minimum rolling resistance. The cleaning comb according to the invention provides effective cleaning of the feet so that material build-up or debris cannot prevent the roller from rotating, effective cleaning being provided in both directions of rotation of the roller, and the cleaning comb not rotation of the roller, and the cleaning comb not being subject to breakage. The cleaning comb comprises a plurality of cleaning comb plates, each plate having a pair of faces that are parallel to the feet flat sides and mounted so that the faces thereof each cooperate with the flat sides of a different circumferential series of feet to effect cleaning thereof. Each cleaning comb plate has an arcuate edge portion joining the faces and extending the entire circumferential distance of the roller within the volume defined by the frame side plates and cross-plates, and each comb is connected to both the top and back cross-plates.

It is the primary object of the present invention to provide an improved compactor assembly, especially for compacting soil in a trench, and a method of utilization thereof. This and other objects of the invention will become clear from an inspection of the detailed description of the invention and from the appended claims.

BRIEF DESCRIPTION OF THE DRAWINGS

FIG. 1 is a side view illustrating an exemplary compactor assembly according to the present invention connected up to a hydraulic boom of a crawler excavator or the like;

FIG. 2 is a front view of the assembly of FIG. 1;

FIG. 4 is a perspective view of one of the primary mounting brackets in FIG. 3;

FIG. 5 is a cross-sectional view, with roller removed for clarity, of the frame of the assembly of FIG. 1, showing the shape of a cleaning comb plate; and FIG. 6 is a perspective view of an exemplary sheep's foot of the roller of FIG. 1.

DETAILED DESCRTIPTION OF THE DRAWINGS

Figure 3:
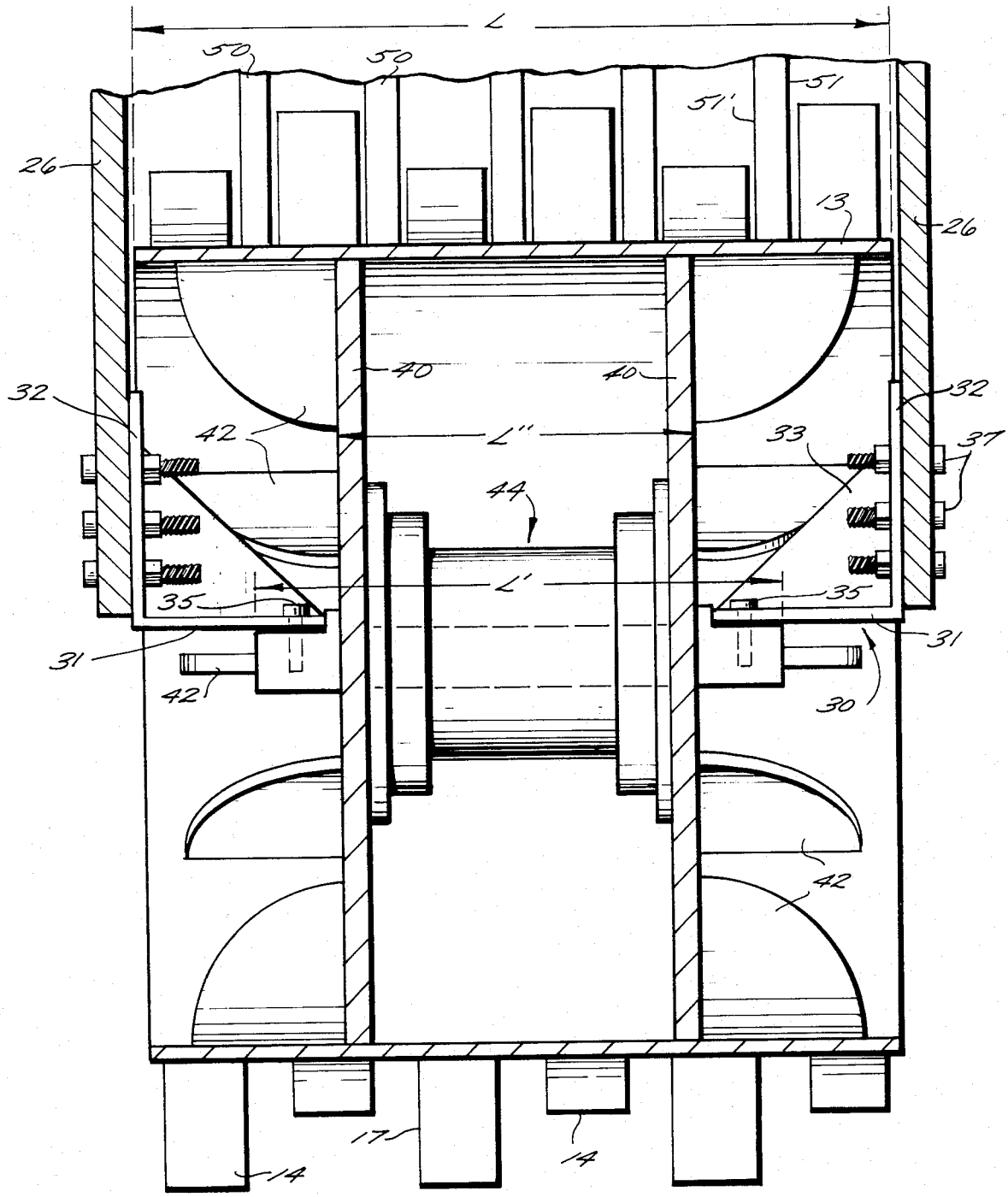
FIG. 3 is a view partly in cross-section and partly in elevation illustrating the details of the manner in which the roller is mounted to the frame side plates.

An exemplary compactor assembly according to the present invention is illustrated generally at 10 in FIG. 1, and is shown therein connected up to a schematic representation of a hydraulic boom B for a crawler excavator or the like.

The assembly 10 includes a sheep's foot roller 12 formed by an exterior cylindrical surface 13 with a plurality of feet 14 extending radially outwardly from the cylindrical surface 13. The cylindrical surface 13 has an axial length L (see FIG. 3 in particular) and defines an open interior volume with a central axis of the cylinder therein.

Each one of the teeth 14, as seen most clearly in FIGS. 2, 3, and 6, comprises a solid member, walls 15, 15' thereof being tapered to a truncated apex 16 in a dimension extending radially outwardly from the cylindrical surface 13 with each apex 16 disposed in a plane parallel to a tangent to the surface 13 of the roller 12. Each member 14 has a pair of parallel flat spaced sides 17, 17', each flat side disposed in a plane perpendicular to the axis of rotation of the roller 12. The feet 14 are disposed in a plurality of series, each series including a plurality of feet extending circumferentially around the roller and each series being axially spaced from adjacent series (a distance slightly greater than the width of the cleaning comb to be hereafter described), each foot in each circumferential series of feet being circumferentially spaced from the feet of any adjacent circumferential series of feet. Each flat side 17, 17' of each member 14 is disposed in a common plane with the flat sides of the other feet in its respective circumferential series of feet.

The assembly 10 further comprises an axle 20 having a length L' (see FIG. 3) less than the length L. Means are provided for mounting the axle along the roller cylindrical surface 13 central axis so that the surface 13 is rotatable about the axle 20 and so that the axle 20 is completely contained within the interior volume defined by the surface 13 (see FIGS. 1 and 3 in particular). The axle 20 has flattened end portions 21 which comprise part of the mounting means for the axle.

A frame 25 operatively mounts the roller 12 to a crawler excavator (hydraulic boom B thereof) or the like, the frame 25 comprising a pair of side plates 26, a top cross-plate 27 interconnecting the side plates 26, and a back cross-plate 28 interconnecting the side plates 26. A suitable mounting bracket 27' is welded to the top plate 27 to effect actual connection of the frame 25 to a boom B of a crawler excavator or the like. The bottom portion 29 of the back plate 28 may serve as a back fill-in grating blade.

Means are provided for mounting the axle 20 to the frame side plates 26 so that the axle 20 remains stationary with respect to the side plates 26 and the roller can rotate about its axis. Such means include the flattened end portions 21 of the roller, and the mounting brackets 30. Each mounting bracket 30 comprises first and second plates 31, 32, respectively, making an angle of about 90° with respect to each other. Preferably a gusset 33 interconnects the plates 31, 32 (see FIGS. 3 and 4 in particular). Means are provided for interconnecting each first plate 31 to the axle flattened portion 21, such as a plurality of bolts 35 passing through elongated openings 34 formed in the first plates 31. Means are also provided for interconnecting each second plate 32 to a frame side plate 26, such as openings 36, corresponding openings (not shown) formed in the frame side plates 26, and a plurality of bolts 37 passing through the openings (see FIG. 3). Interconnection of the axle 20 to the side plates 26 is effected so that each first plate 31 and the axle 20 are located exteriorly of the volume defined by the frame side plates 26 and cross-plates 27, 28. Thus, more than 50% of the feet 14 are exposed at all times for more effective compaction. While the mounting thus provided between the axle 20 and side plates 26 is rugged, it may be detached if necessary for replacement, repair or maintenance.

The means for mounting the axle 20 along the roller cylindrical surface 13 central axis so that the axle is completely contained within the interior volume defined by the surface 13 include a pair of circular plates 40 disposed in the interior of the roller 12, the plates 40 being parallel and spaced apart from each other along the axis of the roller 12 a distance less than the length L'. Each plate has a central opening (unnumbered) formed therein through which the axle 20 extends with the flattened portions 21 being exterior of the plates 40. A plurality of gussets 42 extends between each circular plate 40 and the interior of the roller 12 to positively mount the plates 40 in place and provide stability to the surface 13. The gussets 42 perferably are welded to both the interior of the roller 12 and the plates 40, and the plates 40 are welded in place against the interior of the roller 12. The mounting means further comprises bearing means 44 (see FIG. 3) disposed between the plates 40 and axle 20 for providing rotation of the plates 40 (and the roller 12 rigidly attached thereto) with respect to the axle 20. The bearing means 44 preferably comprises a commercially-available heavy-duty roller bearing in a lifetime sealed unit, such as is conventionally used on crawler mounted machinery. Because the bearing means 44 and axle 20 are completely confined within the surface 13, and because of their particular construction and the construction of the surrounding mounting components, the rotatable mount for the roller is not subject to destruction even during constant use and heavy-duty applications.

A cleaning comb is provided for cleaning the feet 14 to prevent material build-up or debris from preventing rotation of the roller 12, the cleaning comb according to the invention being effective in both directions of rotation of the roller 12. The cleaning comb comprises a plurality of cleaning comb plates 50 (see FIGS. 3 and 5 in particular), one less than the number of circumferential series of feet 14. Each cleaning comb has a pair of faces 51, 51' (see FIG. 3 in particular) that are parallel to the feet flat sides 17, 17', and each cleaning comb plate 50 is mounted so that the faces 51, 51' thereof each cooperate with the flat sides 17, 17', respectively, of a different circumferential series of feet 14 to effect cleaning thereof. Each cleaning comb plate 50 has an arcuate edge portion 52 (see FIG. 5) joining the faces 51, 51' and extending the entire circumferential distance of the roller 12 within the volume defined by the frame side plates 26. Each plate 50 is connected to both the top 27 and back 28 cross-plates.

Preferably, the means for mounting the roller 12 to the side plates 26—in particular the mounting brackets 30—are designed so that the side plates 26 perform a cleaning function on the endmost sides of the endmost circumferential series of feet, as can be seen most clearly in FIG. 2.

The components of frame 25, the cleaning comb plates 50, the roller 12 and solid feet 14, the circular plates 40 and gussets 42, and the like, are preferably all formed of thick steel plate, and are designed so that the assembly 10 has sufficient weight to effect compaction without requiring the boom B to which it is mounted to apply a downward force thereon. Desirably, the weight of the assembly 10 would be about 2300 lbs.

OPERATION

The assembly 10 is formed by mounting the axle flattened portions 21 to the plates 31 of the mounting brackets 30, and then positioning the roller 12 within the frame 25 as indicated in FIG. 1, with the cleaning combs 50 disposed between the circumferential series of teeth 14. The plates 32 of the brackets 30 are then mounted to the side plates 26 of the frame 25 with bolts 37, and the mounting bracket 37' is operatively connected to the boom B of a crawler excavator or the like.

The roller 12 and frame 25 are dimensioned so that the frame 25 is completely insertable in a trench in which soil is to be compacted, the positioning of the axle 20 entirely within the roller 12 and the particular nature of the mounting brackets 30 allowing the assembly 10 to be inserted and operable in a trench no wider than the distance between the plates 26, with effective compaction being provided in such a trench.

Dirt may be scraped and back filled into the trench using the blade portion 29 of the back frame plate 28, and then the boom B is operated to insert the roller 12 into the trench with the feet 14 engaging the soil on the bottom of the trench. The boom B moves the frame 25 along the trench so that the roller rotates on the trench floor and effects compaction of the soil thereof, more than 50% of the feet being exposed and the feet being designed for maximum compaction and minimum rolling resistance. The combs 50 effectively clean off the feet 14 in either direction of rotation of the roller 12, and thus ensure that the roller 12 will not bind. The only force that need be provided by the boom B is the force necessary to move it along the trench, no significant downward pressure to the frame 25 by the boom B being provided.

After sufficient compaction of the soil in the trench, the frame 25 is lifted out of the trench, the trench is further back filled and the compacting steps are repeated.

Thus, it will be seen that according to the present invention an improved compactor assembly and method of utilization thereof have been provided. While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent assemblies and methods.

What is claimed is:

1. A compactor assembly for attachment to a crawler excavator or the like, comprising a sheep's foot roller, having a plurality of feet extending radially outwardly from an exterior cylindrical surface thereof; said cylindrical surface having a central axis and having an axial length L, and defining an open interior volume;

an axle having a length L' less than said length L;

means for mounting said axle along said roller cylindrical surface central axis so that said axle is completely contained within the interior volume defined by said cylindrical surface;

a frame for operatively mounting said roller to a crawler excavator or the like, said frame comprising a pair of side plates and at least one cross-plate; and means for mounting said axle to said frame side plates so that said roller can rotate about said axis.

2. An assembly as recited in claim 1 wherein said means for mounting said axle to said frame side plates comprises means for mounting said axle so that it remains stationary with respect to said side plates and said roller rotates about said axle; said means including a flattened portion formed at each end of said axle; a mounting bracket comprising first and second plates making an angle of 90° with respect to each other; means for interconnecting each said first plate to a said axle flattened end portion; and means for interconnecting each said second plate to a said frame side plate.

3. An assembly as recited in claim 2 wherein said mounting bracket further comprises a gusset interconnecting said first and second plates, and wherein said means for interconnecting each said second plate to a said frame side plate comprises a plurality of openings formed in said second plate adapted to receive bolts passing through corresponding openings formed in the cooperating side plate.

4. An assembly as recited in claim 2 wherein said means for interconnecting each said second plate to a said frame side plate effects interconnection therebetween so that each said first plate, and said axle, are located exteriorly of a volume defined by said frame side plates and at least one cross-plate.

5. An assembly as recited in claim 1 wherein said means for mounting said axle comprise means for mounting said axle so that said cylindrical surface is rotatable about said axis, said means including a pair of circular plates disposed in the interior of said roller, said plates being parallel and spaced apart from each other along the axis of said roller a distance less than the length L'; each said plate having a central opening formed therein through which said axle extends; and bearing means disposed between said plates and axle for providing rotation of said plates with respect to said axle.

6. An assembly as recited in claim 5 wherein said means for mounting said axle further comprise a plurality of gussets extending between each circular plate and the interior of said roller.

7. An assembly as recited in claim 5 wherein said axle has a flattened end portion extending outwardly from each of said circular plates, and wherein said means for mounting said axle to said frame side plates comprises said axle flattened end portions, and further comprises a mounting bracket comprising first and second plates making an angle of 90° with respect to each other, and interconneced by a gusset; means for interconnecting each said first plate to a said axle flattened end portion; and readily removable means for interconnecting each said second plate to a said frame side plate, so that each said first plate, and said axle, are located exteriorly of a volume defined by said frame side plates and at least one cross-plate.

8. An assembly as recited in claim 1 wherein said frame at least one cross-plate comprises top and back cross-plates extending between said side plates; and wherein each of said feet comprises a solid member tapered to a truncated apex in a dimension extending radially outwardly from said cylindrical surface with each truncated apex disposed in a plane parallel to a tangent to said cylindrical surface, and each member having a pair of parallel flat spaced sides, each flat side disposed in a plane perpendicular to the axis of rotation of said roller; and wherein said assembly further comprises a plurality of cleaning comb plates, each cleaning comb plate having a pair of faces that are parallel to said feet flat sides and each cleaning comb plate mounted so that the faces thereof each cooperate with the flat sides of a different series of feet extending circumferentially around said roller cylindrical surface, to effect cleaning thereof; each said cleaning comb plate having an arcuate edge portion forming said faces and extending the entire circumferential distance of said roller within the volume defined by said frame side plates and cross-plates; and each cleaning comb plate being conencted to both said cross-plates.

9. A compactor assembly for attachment to a crawler excavator or the like, comprising a sheet's foot roller, having an exterior cylindrical surface with a plurality of feet extending radially outwardly therefrom and disposed in a plurality of series, each series including a plurality of feet extending circumferentially around said roller, and each series being axially spaced from adjacent series; a frame for operatively mounting said roller to a crawler excavator or the like, said frame comprising a pair of side plates and top and back cross-plates extending between said side plates; a cleaning comb operatively mounted to said frame to clean said roller feet upon relative rotation therebetween; and means for mounting said roller to said side plates for rotational movement with respect thereto; wherein the improvement comprises each of said feet comprises a solid member tapered to a truncated apex in a dimension extending radially outwardly from said cylindrical surface with each truncated apex disposed in a plane parallel to a tangent to said roller; and each member having a pair of parallel flat spaced sides, each flat side disposed in a plane perpendicular to the axis of rotation of said roller, and each flat side disposed in a common plane with the flat sides of the other feet in its respective circumferential series of feet; and said cleaning comb comprises a plurality of cleaning comb plates, each cleaning comb plate having a pair of faces that are parallel to said feet flat sides, and each cleaning comb plate mounted so that the faces thereof each cooperate with the flat sides of a different circumferential series of feet to effect cleaning thereof; each cleaning comb plate having an arcuate edge portion joining said faces and extending the entire circumferential distance of said roller within the volume defined by said frame side plates and cross-plates; and each cleaning comb plate being connected to both said cross-plates.

10. An assembly as recited in claim 9 wherein each foot and each circumferential series of feet is circumferentially spaced from the feet of any adjacent circumferential series of feet.

11. An assembly as recited in claim 9 wherein one less cleaning comb plate is provided than the number of circumferential series of said feet, and wherein said means for mounting said roller to said side plates comprises means for mounting said roller so that said side plates perform a cleaning function on the endmost sides of the endmost circumferential series of feet.

* * * * *